United States Patent [19]

Kaim et al.

[11] Patent Number: 4,537,304

[45] Date of Patent: Aug. 27, 1985

[54] RAILWAY, COUPLER YOKE, DRAFT GEAR AND FOLLOWER ASSEMBLY

[75] Inventors: John W. Kaim, Chicago; Norman A. Berg, Wheaton, both of Ill.; Russell G. Altherr, Munster, Ind.

[73] Assignee: AMSTED Industries Incorporated, Chicago, Ill.

[21] Appl. No.: 458,205

[22] Filed: Jan. 17, 1983

[51] Int. Cl.[3] ..... B65D 85/68; B65B 13/02

[52] U.S. Cl. ..... 206/335; 29/436; 53/399; 213/1 R; 403/12

[58] Field of Search ..... 29/434, 469, 436; 53/399; 206/318, 335, 525, 527; 213/50, 67 R, 67 A, 1 R; 267/138; 403/12

[56] References Cited

U.S. PATENT DOCUMENTS

| | | | |
|---|---|---|---|
| 1,766,609 | 6/1930 | Dath | 213/67 A X |
| 2,571,748 | 10/1951 | Newman | 206/335 |
| 2,950,002 | 8/1960 | Eastberg | 206/318 |
| 3,583,061 | 6/1971 | Adams | 29/469 |
| 3,856,153 | 12/1974 | Cope | 213/67 A |
| 4,158,407 | 6/1979 | Rest | 206/318 |

*Primary Examiner*—Randolph A. Reese
*Assistant Examiner*—David F. Hubbuch
*Attorney, Agent, or Firm*—Charles E. Bouton; Edward J. Brosius

[57] ABSTRACT

A railway coupler yoke assembly is provided. A yoke, draft gear and follower are assembled as a unit assembly and maintained as such by the installation of bands at various locations about the assembly. Such yoke assembly can then be shipped and stored as an assembly until the time of installation in a railway car. At such time, the bands are cut and the assembly is placed in the railway car.

5 Claims, 4 Drawing Figures

RAILWAY, COUPLER YOKE, DRAFT GEAR AND FOLLOWER ASSEMBLY

BACKGROUND OF THE INVENTION

The present invention relates generally to a railway coupler yoke, draft gear and follower assembly and more particularly to a railway coupler yoke, draft gear and follower assembly banded together in a ready to install unit.

In the assembly of a railroad car, it has been standard practice to have the car builder or car maintenance employees obtain a draft gear and follower from a separately supplied stock of each and assemble them into one of a group of separately supplied yokes. The on site assembled unit is then applied to the car sill for attachment to a coupler by means of a key or connector pin. The draft gear must be shipped in a gagged or partially compressed condition in order to be able to be placed within the yoke. Such gagging is accomplished by the presence of a temporary mechanical restraint within the draft gear which is sheared or released by the application of a service force. If such restraints released during shipment or the assembly operation, the possibility of injury to the assembler is present. Since the above assembly is only a part-time job, the lack of employee efficiency adds to the potential danger, the labor time and assembly cost of the railway car.

Accordingly, it is an object of the present invention to provide a railway coupler yoke, draft gear and follower assembly in a ready to install unit.

SUMMARY OF THE INVENTION

The present invention provides a railway coupler yoke, follower and draft gear assembly in a ready to install unit. A draft gear in a gagged or compressed condition is placed and held in that condition within the central pocket of a coupler yoke. A follower is inserted in the central pocket of the yoke between the draft gear and the head portion of the yoke. The yoke, draft gear and follower assembly is maintained as a unit by placing a band around the yoke, the draft gear and the follower in line with the longitudinal axis of the yoke. A second band may be provided transverse to the longitudinal axis of the yoke extending around the draft gear and the yoke straps. The bands are removed just prior to the assembly of the yoke, draft gear and follower assembly into the railway car. Such assembly method permits a factory matched and assembled yoke, draft gear and follower to be shipped and stored as a unit, and then only at the time of assembly, to have the bands cut and be placed in the railway car. The present invention also provides a method of assembling a railway car yoke, follower and draft gear comprising the steps of providing a coupler yoke having a head portion at an end thereof, with two elongated strap portions extending from said head portion to a rear portion joining the two strap portions to form a central pocket in said yoke, providing a compressed draft gear within the central pocket and a follower between the draft gear and the head portion of said coupler yoke, and placing a band means around the coupler yoke, draft gear and follower assembly in line with the longitudinal axis of the yoke, with the band means extending around the outside of the rear portion of the yoke and around the draft gear, the follower and the yoke head portion so as to maintain the draft gear and the follower within the central pocket of the yoke prior to assembly within a railway car.

DESCRIPTION OF THE PREFERRED EMBODIMENT

Figure 1:
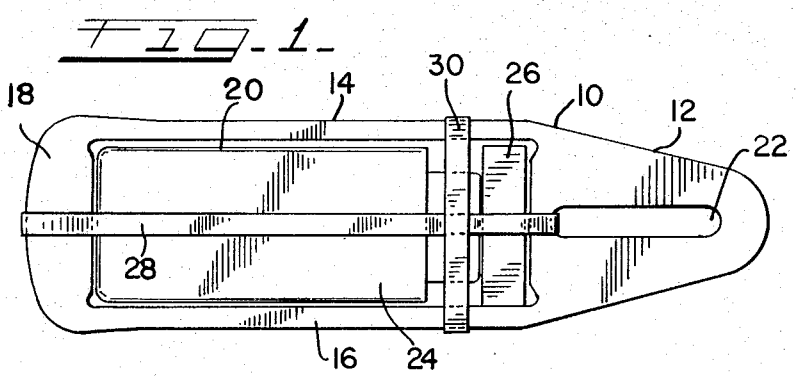
FIG. 1 is a side view of a type E railway coupler yoke with draft gear and follower banded together.
Figure 2:
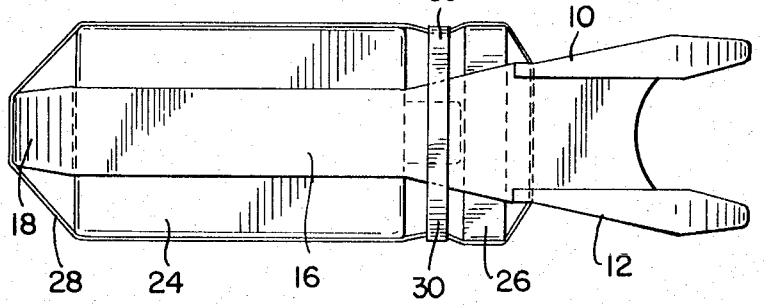
FIG. 2 is a top view of a type E railway coupler yoke with draft gear and follower banded together.

A first embodiment of the present invention is shown in FIGS. 1 and 2. A type E coupler yoke 10 is shown. Yoke 10 comprises a head portion 12, straps 14 and 16 extending back from head portion 10, and a rear portion 18 which connects straps 14 and 16 so as to form a central pocket 20 within yoke 10 which is open at the two sides between the straps 14 and 16. An elongated keyslot 22 is centrally located in head portion 12. The length of keyslot 22 runs parallel to the longitudinal axis of yoke 10. A draft gear 24 is positioned in the central pocket 20 extending from the front of rear yoke portion 18 to rear head portion 12. A follower 26 is located between the front of draft gear 24 and the rear of yoke head portion 12. The draft gear normally includes a housing having top, bottom and side walls and a cushioning means located within the housing.

A metal band 28 extends parallel to the longitudinal axis of yoke 10 around the outside of the rear portion 18 of yoke 10, across the two open sides and draft gear 24 and follower 26 and through keyslot 22 in the head portion 12 of yoke 10. Preferably a second metal band 30 extends transversely to the longitudinal axis of yoke 10 around draft gear 24. Both bands act to keep draft gear 24 and follower 26 within yoke central pocket 20 until the time of installation of the yoke 10 in a railway car. At that time, the bands would be cut when the yoke assembly would be placed in a railway car.

Figure 3:
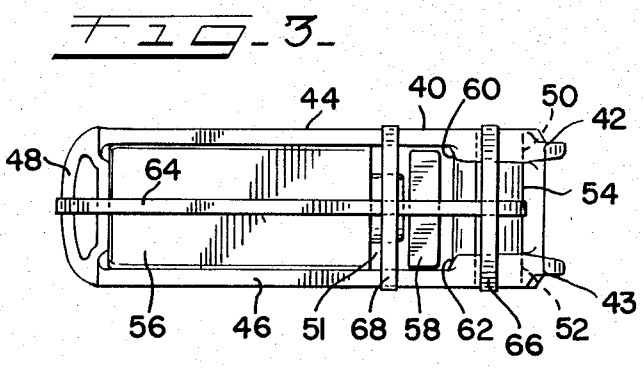
FIG. 3 is a side view of a type F railway coupler yoke with pin, draft gear and follower banded together.
Figure 4:
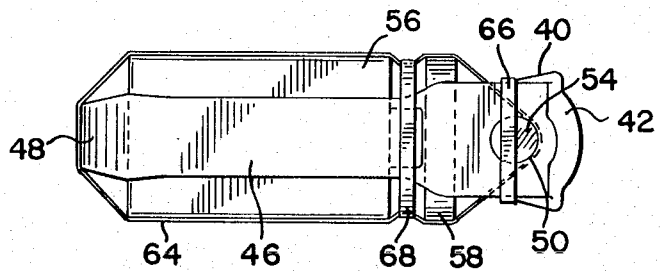
FIG. 4 is a top view of a type F railway coupler yoke with pin, draft gear and follower banded together.

A second embodiment of the present invention is shown in FIGS. 3 and 4. A type F coupler yoke 40 is shown. Yoke 40 comprises a strap 44 and a strap 46. Strap 44 has a head portion 42, and strap 46 has a head portion 43. A rear portion 48 connects straps 44 and 46 so as to form a central pocket 51 within yoke 40 which is open at the two sides between the straps 44 and 46. A pin hole 50 extends through head portion 42 of strap 44 and a pin hole 52 extends through head portion 43 of strap 46. A pin 54 extends through pin holes 50 and 52. A draft gear 56 is positioned in the central pocket 51 extending from the front of rear yoke portion 48 to strap head portions 42 and 43. A follower 58 is located between the front of draft gear 56 and interval raised portion 60 of head portion 42 and interval raised portion 62 of head portion 43.

A metal band 64 extends parallel to the longitudinal axis of yoke 40 around the outside of the rear portion 48 of yoke 40, across the open sides and draft gear 56, follower 58, and pin 54. A second metal band 66 extends transversely to the longitudinal axis of yoke 40 around the head portion 42 and head portion 43 and around pin holes 50 and 52 to maintain pin 54 in pin holes 50 and 52. A third metal band 68 extends transversely to the longitudinal axis of yoke 40 around strap 44 and strap 46 to aid in maintaining draft gear 56 and follower 58 within yoke central pocket 51. At the time of installation of the yoke 40 in a railway car, all the bands would be cut and pin 54 would be removed. The yoke assembly would be placed in a railway car and a coupler shank (not shown) would be inserted into the yoke and retained therein by the insertion of pin 54.

What is claimed is:

1. A pre-assembled railway car yoke, follower and draft gear assembly comprising a coupler yoke having a head portion at one end thereof with an opening therein and two elongated strap portions extending from said head portion to a rear portion joining said two strap portions to form a central pocket with two open sides in said yoke, a partly compressed draft gear means in said central pocket of said yoke between said two strap portions, said draft gear means comprising a housing having top, bottom and side walls and a cushioning means located within said housing, a follower between said draft gear means and said yoke head portion in said central pocket of said yoke, and a band means extending in line with the longitudinal axis of said yoke to hold said draft gear and said follower in said central pocket of said yoke, said band means extending around the outside of said rear portion of said yoke, across the said two open sides and around the draft gear, the follower and into the yoke head portion so as to maintain the draft gear and the follower in the central pocket of the yoke prior to assembly within a railway car.

2. The assembly of claim 1, wherein the band means extends through the opening in the head portion of the yoke.

3. The assembly of claim 1, wherein a second band means extends transversely to the longitudinal axis of the said yoke and extends around the draft gear and the yoke strap portions.

4. The assembly of claim 1, further including a pin extending through the opening in the yoke head portion, wherein said band means extends around a central circumference of said pin and a second band means extends around the top and bottom of said pin to maintain the pin in the opening in the yoke head portion.

5. A method of pre-assembly a railway car yoke, follower and draft gear comprising the steps of providing a coupler yoke having a head portion at one end thereof, two elongated strap portions extending from said head portion and a rear portion joining said two strap portions to form a central pocket in said yoke having two open sides, providing a draft gear in said central pocket and a follower between said draft gear and said head portion of said coupler yoke, placing a band means around the coupler yoke, draft gear and follower assembly in line with the longitudinal axis of the yoke, said band means extending around the outside of the rear portion of the yoke and across said two open sides around the draft gear, the follower and into the yoke head portion so as to maintain the draft gear and the follower partly compressed in the central pocket of the yoke prior to assembly within a railway car.

* * * * *